US006167585B1

(12) United States Patent
Fridman et al.

(10) Patent No.: US 6,167,585 B1
(45) Date of Patent: Jan. 2, 2001

(54) SERRATED HAND TOOL FOR PLASTER APPLICATION

(76) Inventors: Emelian Fridman, 37 Clara St., 2nd Floor, Brooklyn, NY (US) 11218; Mikhail Katz, 1924 E. 29th St., Brooklyn, NY (US) 11229

( * ) Notice: Under 35 U.S.C. 154(b), the term of this patent shall be extended for 0 days.

(21) Appl. No.: 09/350,347

(22) Filed: Jul. 14, 1999

(51) Int. Cl.[7] ..... B05C 17/10

(52) U.S. Cl. ..... 15/245.1; 15/235.6; 15/236.08; D8/45

(58) Field of Search ..... 15/142, 210.5, 15/235.4, 235.6, 236.01, 236.02, 236.06, 236.08, 245.1; 425/458; D8/45; D32/46, 49

(56) References Cited

U.S. PATENT DOCUMENTS

| | | | | |
|---|---|---|---|---|
| D. 168,412 | * | 12/1952 | Le Boeuf | D32/49 X |
| 711,423 | * | 10/1902 | Greene et al. | 15/236.08 X |
| 1,422,773 | * | 7/1922 | McCarthy | 15/236.08 X |
| 1,930,977 | * | 10/1933 | Kirch | 15/236.08 X |
| 1,961,531 | * | 6/1934 | Seek | 15/236.08 X |
| 4,064,588 | * | 12/1977 | Cooper | 15/236.08 |
| 4,316,302 | | 2/1982 | Clark | 15/235.4 |
| 4,497,114 | | 2/1985 | Belcher | 33/41.4 |
| 4,759,092 | * | 7/1988 | Duddy | 15/236.08 |
| 4,804,321 | | 2/1989 | Riesgo | 425/87 |
| 5,231,729 | | 8/1993 | Rose | 15/235.4 |
| 5,524,316 | | 6/1996 | Johnson | 15/210.5 |
| 5,607,256 | | 3/1997 | McCleary | 404/105 |
| 5,723,185 | | 3/1998 | Beier et al. | 427/429 |
| 5,778,482 | | 7/1998 | Sbrigato | 15/245.1 |

* cited by examiner

*Primary Examiner*—Mark Spisich
(74) *Attorney, Agent, or Firm*—Boris Leschinsky

(57) ABSTRACT

A novel plaster application method includes the first step of applying the plaster in a plurality of parallel and spaced apart lines using a novel hand tool so that the upper edges of each plaster line define the plane of the final plaster surface. After allowing the plaster lines to dry and harden, the second step is to fill the spaces between the lines with more plaster forming the final plaster surface by raising the level of plaster to the plane of the final surface. More layers of plaster may be applied if needed. A serrated hand tool is proposed for aiding the plaster spreading which contains a plurality of generally triangular teeth with oval upper portions and blunt lower ends defining the distal edge of the tool. The new method allows a faster application of plaster in a construction practice with reduced consumption of plaster material.

1 Claim, 1 Drawing Sheet

SERRATED HAND TOOL FOR PLASTER APPLICATION

BACKGROUND OF THE INVENTION

1. Field of the Invention

The present invention relates generally to a method and a hand tool for plaster spreading and more specifically to serrated hand tools for spreading plaster and the like.

2. Description of the Prior Art

Construction practice have long required a reliable method and appropriate hand tool to spread plaster and other similar type compounds such as gypsum, cement, mortar, group, joint mixes, spackling pastes, etc. All of these and other similar compounds are described herein as "plaster" for the purposes of this specification.

For an experienced worker, spreading a plaster compound over a perfectly flat and well prepared surface does not present a challenge. It is when the surface is not flat as is encountered in most cases, when the presently known spreading methods need improvements.

In a commonly known plaster spreading technique, a hand tool or trowel with a straight edge is used to take some soft plaster from a container and apply it over the working surface trying to maintain a constant thickness of the layer of plaster. This thickness depends on the skill of the worker and the force with which the plaster is applied. However, when the surface has bumps or valleys, maintaining the constant depth becomes quite difficult. As a result, the final surface of the hardened compound is not perfectly flat. In order to improve this technique, it is known to apply the plaster in several steps, building up the plaster layers in a gradual way. This method requires a long time to complete because every consecutive layer of plaster has to cure at least 1 to 2 hours before the next one can be applied. Typically, at least three layers of plaster are applied this way to achieve a good result. Care should also be taken not to allow cracking of the plaster compound which may occur due to excessive and uneven thickness of the plaster layer. In addition, due to natural irregularities of this plaster application method, some hardened plaster has to be periodically removed to smooth out the surface which requires more working time. Finally, that and excessive thickness of plaster also lead to a higher consumption of plaster material and hence, higher material waste.

Serrated or notched trowels and hand tools are known in the prior art mostly for applying glue and tile compounds. They typically have a plurality of V-shaped or square notches along the working edge and are designed to evenly distribute the paste preparing the surface to be covered with tiles, linoleum and alike. Following examples illustrate some known serrated hand tools.

U.S. Pat. No. 2,287,231 by Cathcard is directed to a paste spreader for spreading paste, cement, glue and the like on a surface to be covered with a covering such as linoleum which evenly distributes the paste. The spreader blade is fabricated of a flexible material and is serrated along one edge.

U.S. Pat. No. 2,824,330 by Williams is directed to a spreader for cement and the like on a surface to be covered with a covering, such as Formica, which evenly spreads the cement. The spreader blade is square and is removably attached to a handle. Each of the four edges of the blade has different sized notches or serrations.

U.S. Pat. No. 3,916,472 by Carder is directed to a trowel for applying adhesives to a surface such as a floor or wall to be covered. The edges of the trowel are serrated to evenly spread the adhesive.

U.S. Pat. No. 4,316,302 by Clark is directed to an adhesive spreading trowel having all four edges either straight or serrated and is adapted for manufacture by injection molding.

U.S. Pat. No. 4,654,919 by Lieberman is directed to a spreader for applying plaster and cement to wallboard. The spreader has a spreader blade attached to a handle with a backing layer next to the blade to add rigidity to the blade. The edge of the blade extends past the edge of the backing layer. The plate is made of a flexible material such as plastic and has a straight edge as opposed to a serrated edge.

U.S. Pat. No. 4,804,321 by Riesgo is directed to a cement spreader with a blade having a plurality of squared notches.

U.S. Pat. No. 5,231,729 by Rose is directed to a tilers trowel having square notches and adjustment means for limiting the depth of material which can be applied.

U.S. Pat. No. 5,524,316 by Johnson is directed to a hand tool for spreading plaster on a substrate such as a ceiling and alike in decorative patterns. The tool has stiff but resilient serrated blade and a handle attached to the blade at an opposite or proximal edge from a serrated distal edge. Tool alignment marks are also provided to aid in decorative application of the plaster compound.

Finally, U.S. Pat. No. 5,778,482 by Sbrigato is directed to a serrated spreader for a cold-coat of roofing tar. It contains a hard rubber blade with serrations, which, when pushed over the surface to be roofed, spreads the desired coat of tar over a predetermined width of the surface to be roofed.

These and other known devices of the prior art fail to address the main problem of the plaster spreading work, namely allow for a quick to apply method of accurate plaster spreading over an imperfect surface without the need for multiple repetitive applications of plaster. Therefore, the need exists for a method and a hand tool to allow for such improvement in the plaster allying technique. In addition, the need exists for a plaster application method and a hand tool allowing for lower level of skill required to achieve smooth final surface, reducing the drying time between the layers, reducing the tendency of plaster to form cracks, and reducing the plaster material waste.

SUMMARY OF THE INVENTION

Accordingly, it is an object of the present invention to overcome these and other drawbacks of the prior art by providing a novel method and a hand tool for plaster spreading using a serrated edge principle.

It is another object of the present invention to provide a method and a hand tool for plaster spreading allowing to substantially reduce the total time required to achieve the final smooth surface.

It is a further object of the present invention to provide a method and a hand tool for plaster spreading allowing to achieve a final smooth surface over somewhat irregular initial surface, all with lower level of worker skills.

Finally, it is another object of the invention to provide a method and a hand tool allowing plaster spreading with minimum waste of plaster material.

According to the method of the invention, a commonly known serrated edge principle is used in a novel way to aid in plaster spreading. After the surface is initially prepared to eliminate larger defects, the first step of a novel method includes applying a so called skim-coat of plaster using a serrated hand tool of a special novel design. Very little level of skill is required to apply a plurality of parallel plaster lines, the upper edges of which form a perfectly flat surface in spite of the irregularities of the underlying surface. It takes substantially less time for these lines to dry and harden as opposed to a regular generally thicker layer of solid plaster, in our experience about 20 to 30 minutes. Also, due to limited thickness of each individual plaster line, they almost never crack. The result of the first step is a plurality of parallel plaster lines having their upper edges defining the level plane of the final surface.

A second step of the novel method includes applying of a second coat of plaster over the dry plaster lines formed in the first step by filling the space between the lines with additional plaster using a regular hand tool or trowel with a straight edge. This step is also quite simple due to the fact that the hand tool edge slides along the hardened upper edges of the plaster lines formed in the first step so the surface is well defined and the final result does not depend on the level and consistency of force applied to the handle of the hand tool while spreading the plaster.

As a result of the first two steps, a smooth surface is formed over a layer of plaster of minimum thickness. Less skill and substantially less time are required to achieve good results. In addition, since the total thickness of plaster is minimized, less plaster material is needed to complete the job. Finally, minimum thickness also allows to substantially diminish the tendency of plaster to form cracks while drying.

In many cases, only these two steps are required to complete the plaster application job. However, in some other situations depending on the specific requirements and surrounding conditions, more layers of plaster may be applied using either again the first two steps as outlined above or simply raising the level of plaster using conventional tools and techniques.

A novel serrated hand tool is designed to assist with the first step of the present invention. A tool blade is equipped with a handle located opposite the serrated edge. The edge is formed of a plurality of generally triangular teeth having one line perpendicular and the other line at an angle of between 35 and 45 degrees to the edge line. Also, both the lower and the upper corners of each tooth are smoothed out to prevent scratching of the surface as well as to allow the formation a uniform upper edge of each line of plaster.

For a better understanding of the invention, its operating advantages and the specific objects attained by its uses, reference should be made to the accompanying drawings and descriptive matter in which there is illustrated a preferred embodiment of the present invention.

BRIEF DESCRIPTION OF THE DRAWINGS

A more complete appreciation of the subject matter of the present invention and the various advantages thereof can be realized by reference to the following detailed description in which reference is made to the accompanying drawing in which.

DETAILED DESCRIPTION OF THE MOST PREFERRED EMBODIMENT OF THE INVENTION

Figure 1:
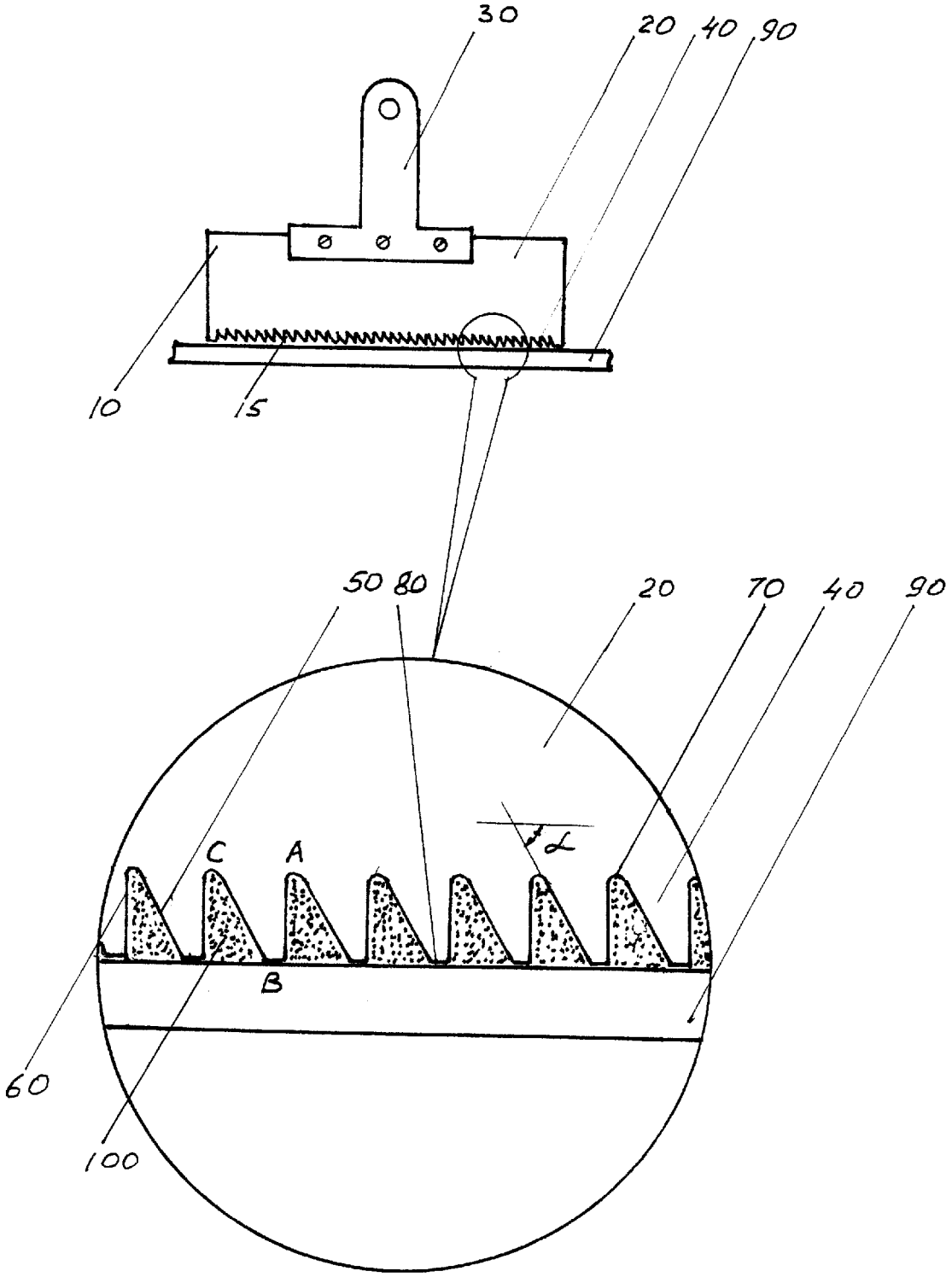
FIG. 1 is a view of a hand tool according to the present invention showing an enlarged portion of a serrated blade edge.

A detailed description of the present invention follows with reference to accompanying drawings in which like elements are indicated by like reference numerals.

According to the method of the present invention, two novel steps of plaster spreading are proposed. The first step is the application of a skim-coat of plaster material over initially prepared surface (90) using a serrated hand tool (10) of a novel design illustrated on FIG. 1.

The hand tool (10) contains a blade (20) with a handle (30) attached opposite the serrated longitudinal distal blade edge (15). Blade (20) may be made of metal or plastic material of appropriate hardness. Teeth (40) are placed along the length of the blade edge (15). Each tooth is of generally triangular shape which is defined by points A, B, and C. Our evaluation indicates that although many shapes of teeth and notches would produce acceptable results in use, the best utility can be achieved by making the triangular tooth in the following way: line (60) or line A–B of ABC triangle is perpendicular to the blade edge (15) while line (50) or line B–C forms a certain angle $\alpha$ with the blade edge (15). For best results, the value of that angle is designed to be between about 35 and about 45 degrees as shown on FIG. 1.

Another improvement of the shape of each tooth (40) is in its upper portion, in the vicinity of points A or C. It is proposed not to have a sharp pointed angle but rather make a smooth oval shape transition (70) from one tooth to the next. The purpose of this transition (70) is to eliminate the sharp upper edge of the plaster line when the tool is used. Sharp line of plaster is easily cracked while the oval blunt shape of the plaster line leads to reliable and hard to crack upper edge. Another reason to avoid sharp angle is to prevent irregular filling of it with viscous plaster paste. Due to high viscosity, the plaster paste fills the oval shape much better and more consistently.

A further yet improvement of the shape of the tooth (40) is in the shape of the lower end of the tooth. Most hand tools of the prior art having V-shaped notches contain a sharp lower end of each tooth which may lead to scratching and other damaging of the surface of the wall or the ceiling that the construction worker is working on. According to the present invention, each tooth (40) has a blunt and generally flat lower end (80) in the vicinity of point B as shown on FIG. 1 to avoid these potential problems. Also, flat ends (80) allow for a smooth gliding of the hand tool (10) along the surface substrate (90).

According to the method of the invention, the first step is best done using the hand tool (10) described above. Taking some plaster paste material from the plaster container on the edge (15) of the blade (20), the construction worker can spread that plaster along the substrate surface (90) forming a plurality of parallel plaster lines (100) of generally triangular shape and equal height as shown on FIG. 1. Due to limited height and space between the plaster lines (100) caused by the presence of flat edges (80), it takes only a short time, typically about 20 to 30 minutes for the plaster lines to dry and harden. It is also important to point out that a plurality of upper edges of these lines (100) are formed all in one general plane which is helpful at the next step of the plaster spreading sequence. Additionally, due to their limited thickness, plaster lines do not crack as easily as a solid layer of plaster of variable thickness.

A second step of the novel method includes applying of a second coat of plaster over the dry plaster lines formed in the first step by filling the spaces between the lines with more plaster using a regular hand tool with a straight edge. Since application of plaster occurs over a plurality of hardened plaster lines, this step is quite simple due to the fact that the hand tool edge simply slides along the hardened upper edges of the plaster lines formed in the first step so that paste plaster fills the spaces between the plaster lines of the first step. Since the top surface is well defined by the upper edges of the plaster lines, the final result does not depend on the level of skill and consistency of force applied to the handle of the hand tool while spreading the plaster. Filling the spaces between the plaster lines completes the formation of a perfectly smooth plaster surface of minimum thickness over an irregular initial substrate surface.

As was indicated above, in many instances it is enough to apply these two steps of the novel method to achieve a satisfactory result. In fact, it is preferred to limit the plaster spreading job just to these steps in order to limit the material consumption. However, should it be necessary to raise the level of the plaster further, it is possible to apply additional layers of plaster over the initial layer with either conventional techniques or repeating the first two steps of the novel method of the present invention. Since the initial layer generally provides with a flat surface, it makes it easier to apply additional plaster layers over this generally flat new substrate.

Although the present invention has been described with respect to a specific embodiment and application, it is not limited thereto. Numerous variations and modifications readily will be appreciated by those skilled in the art and are intended to be included within the scope of the present invention, which is recited in the following claims.

What we claim is:

1. A serrated hand tool for applying a plaster compound over a substrate surface, said tool comprising:

(a) an elongated handle, and (b) a straight blade defining a plane and having longitudinal distal and proximal edges, said handle secured to and extending from a mid-portion of said proximal edge wherein the longitudinal axis of the handle is substantially coplanar with the plane of the blade, said distal edge defined by a plurality of teeth, each tooth being of a generally triangular shape, said shape defined by a first side of the tooth and a second side of the tooth, said first side being perpendicular to said distal edge and substantially parallel to the axis of the handle and said second side forming an acute angle with said distal edge of about 35 to 45 degrees.

* * * * *